US009301565B1

(12) United States Patent
Mondrella

(10) Patent No.: US 9,301,565 B1
(45) Date of Patent: Apr. 5, 2016

(54) HEADWEAR SUPPORT SYSTEM

(71) Applicant: William Mondrella, Lockport, IL (US)

(72) Inventor: William Mondrella, Lockport, IL (US)

( * ) Notice: Subject to any disclaimer, the term of this patent is extended or adjusted under 35 U.S.C. 154(b) by 0 days.

(21) Appl. No.: 14/513,787

(22) Filed: Oct. 14, 2014

(51) Int. Cl.

| | |
|---|---|
| ***A42B 1/02*** | (2006.01) |
| ***A42B 1/08*** | (2006.01) |
| ***A42C 1/04*** | (2006.01) |
| ***A42B 1/00*** | (2006.01) |
| ***A47G 25/10*** | (2006.01) |

(52) U.S. Cl.
CPC . *A42B 1/002* (2013.01); *A42B 1/08* (2013.01); *A42C 1/04* (2013.01); *A47G 25/10* (2013.01)

(58) Field of Classification Search
CPC ..... A42B 1/02; A42B 1/22; A42B 1/002; A42B 1/08; A42C 1/04; A45C 11/02
See application file for complete search history.

(56) References Cited

U.S. PATENT DOCUMENTS 3,992,721 A * 11/1976 Morton ..... A42C 2/007 2/414
4,491,256 A * 1/1985 Payne ..... D06F 59/02 223/24
4,708,271 A * 11/1987 Grommes ..... A42B 1/002 211/32
5,144,695 A * 9/1992 Schweizer ..... A42B 7/00 2/175.6
5,289,591 A * 3/1994 Andersen ..... A42B 1/08 2/195.5
D361,197 S * 8/1995 Wilson ..... D2/892
5,725,134 A * 3/1998 Weltge ..... A42B 1/002 223/24
5,887,289 A * 3/1999 Theoret ..... A42B 1/08 2/195.1
6,125,997 A * 10/2000 Campbell ..... A45C 11/02 206/278
D458,737 S * 6/2002 Fuerst ..... D2/892
7,096,512 B2 * 8/2006 Blair ..... A42B 1/08 2/410
2012/0024916 A1 * 2/2012 Horner ..... A42B 3/006 224/259
2014/0123372 A1 * 5/2014 Shen ..... A42B 3/068 2/414
2015/0237944 A1 * 8/2015 Floyd, Jr. ..... A42B 1/08 2/414

FOREIGN PATENT DOCUMENTS

JP 09201268 A * 8/1997

* cited by examiner

*Primary Examiner* — Ismael Izaguirre
(74) *Attorney, Agent, or Firm* — Carter, DeLuca, Farrell & Schmidt, LLP

(57) ABSTRACT

A headwear support system includes a support base having a shape that is generally one-half of a hemisphere. The support base includes a front projection extending outwardly therefrom, a rear connection rib coupled to a top rear of the support base, and two diametrically-opposed apertures on a bottom rear of the support base. The headwear support system further includes a first elastic member having opposed ends, each end configured to be coupled to respective ones of the diametrically-opposed apertures and wherein the first elastic member is configured to selectively secure the headwear to the support base. The headwear support system also includes a second elastic member configured to be coupled to the rear connection rib and configured to be selectively coupled to a button of the headwear. A clip member is also included in the system and is configured to be coupled to the rear connection rib and configured to be selectively coupled to a travelling case.

16 Claims, 4 Drawing Sheets

HEADWEAR SUPPORT SYSTEM

BACKGROUND

1. Technical Field

The present disclosure relates to a headwear support system and, more particularly, to a sports cap support system that can be used to protect the cap's integrity during transportation or storage.

2. Background of Related Art

Any golfer who has travelled to play golf has probably encountered the issue of how to pack their caps so that they do not get smashed or lose their shape and/or integrity during transportation. Whether it's packing them within luggage or to the outside of a golf travel case, this is often a big issue. Some pack the inside of the caps with apparel such as socks and underwear. Some just "fold in" the back of the cap toward the front. And some carry them separately in a carry-on bag. The same issue may apply to other types of headwear, such as baseball caps or non-sports related headwear.

SUMMARY

A headwear support system includes a support base having a shape that is generally one-half of a hemisphere. The support base includes a front projection extending outwardly therefrom, a rear connection rib coupled to a top rear of the support base, and two diametrically-opposed apertures on a bottom rear of the support base. The headwear support system further includes a first elastic member having opposed ends, each end configured to be coupled to respective ones of the diametrically-opposed apertures and wherein the first elastic member is configured to selectively secure the headwear to the support base. The headwear support system also includes a second elastic member configured to be coupled to the rear connection rib and configured to be selectively coupled to a button of the headwear. A clip member is also included in the system and is configured to be coupled to the rear connection rib and configured to be selectively coupled to a travelling case.

In one aspect of the disclosure, the rear connection rib defines a pair of opposed inward projecting ribs extending to a bottom rear of the support base and defining two diametrically-opposed tabs and a pair of opposed apertures disposed therethrough.

In one aspect of the disclosure, the headwear support system further comprises a third elastic member having opposed ends configured to be coupled to one of respective ones of the diametrically-opposed tabs or respective ones of the opposed apertures disposed through the inward projecting ribs.

In one aspect of the disclosure, the support base may be formed from a polymer material.

In another aspect of the disclosure, the front projection has a shape that is either flat or curved.

In another aspect of the disclosure, the first elastic member and the second elastic member is either a bungee cord or an elastic band.

In another aspect of the disclosure, the rear connection rib includes three apertures, a first aperture for coupling the clip member thereto, and second and third apertures disposed on either side of the first aperture for coupling the second elastic member thereto.

BRIEF DESCRIPTION OF THE DRAWINGS

Various aspects of the present disclosure are described herein with reference to the drawings wherein like reference numerals identify similar or identical elements.

DETAILED DESCRIPTION

Figure 1:
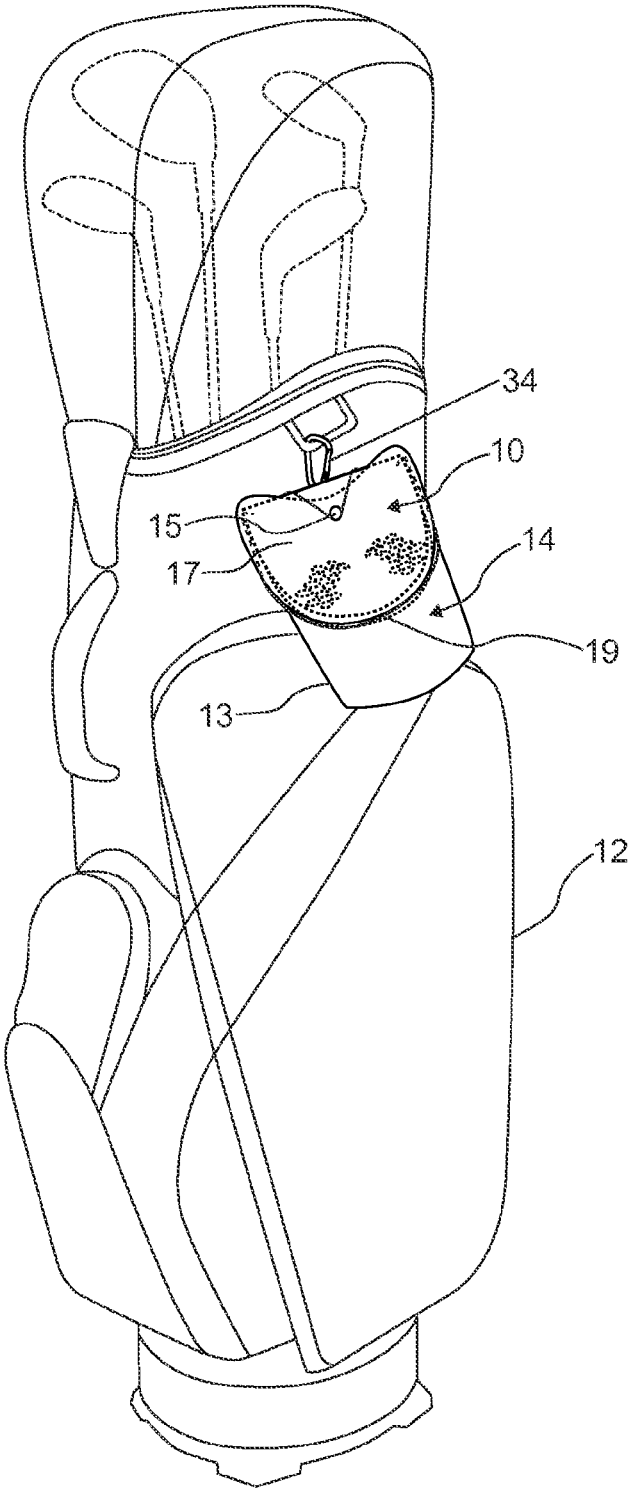
FIG. 1 illustrates a headwear support system coupled to a golf travel bag and having a golf cap mounted thereon according to one embodiment of the present disclosure.

FIG. 1 illustrates a headwear support system 10 coupled to a travelling case 12 and having headwear 14 mounted thereon according to one embodiment of the present disclosure. Generally, headwear support system 10 functions to protect the integrity of headwear 14 during transportation or storage of headwear 14 and is configured to be selectively coupled to travelling case 12 via a clip member 34. Embodiments of headwear support system 10 are described below in conjunction with FIGS. 2A through 3.

Although travelling case 12 is depicted in FIG. 1 as a golf travel bag, travelling case 12 may be any suitable travelling case, such as luggage, a golf bag, a sports bag, a car seat, a backpack, or other suitable travel baggage.

As shown in FIG. 1, headwear 14 is depicted as a golf cap; however, headwear 14 may be any suitable headwear, such as a baseball cap, a fedora, a cowboy hat, a bucket hat, or other suitable apparel that can be worn on a head of a human (or any suitable animal if one so desires). Headwear 14 includes a crease 19 formed by an intersection of a crown 17 and a brim 13. Headwear 14 typically has some stiffness that allows it to take a particular form so as to be worn on a head. This form is desired to be kept intact so that it does not lose its integrity in some way that will either prevent a user from wearing it or diminish its aesthetic value. During transportation, such as when travelling with luggage, headwear 14 can lose its integrity if not stored or packed properly. According to the teachings of the present disclosure, headwear support system 10 is utilized to transport headwear 14 so that it maintains its integrity during transportation using travelling case 12.

Figure 2A:
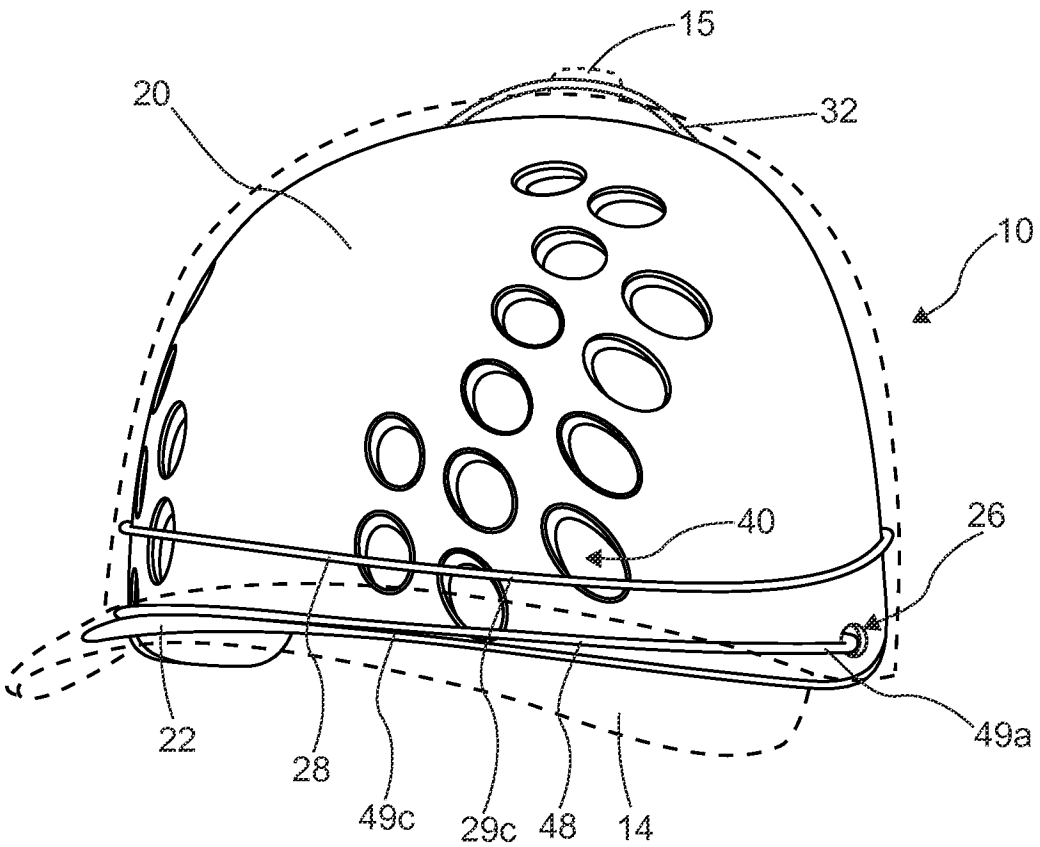
FIG. 2A is a front perspective view of the headwear support system of FIG. 1 with the golf cap (shown in phantom) mounted thereon according to one embodiment of the present disclosure.
Figure 2B:
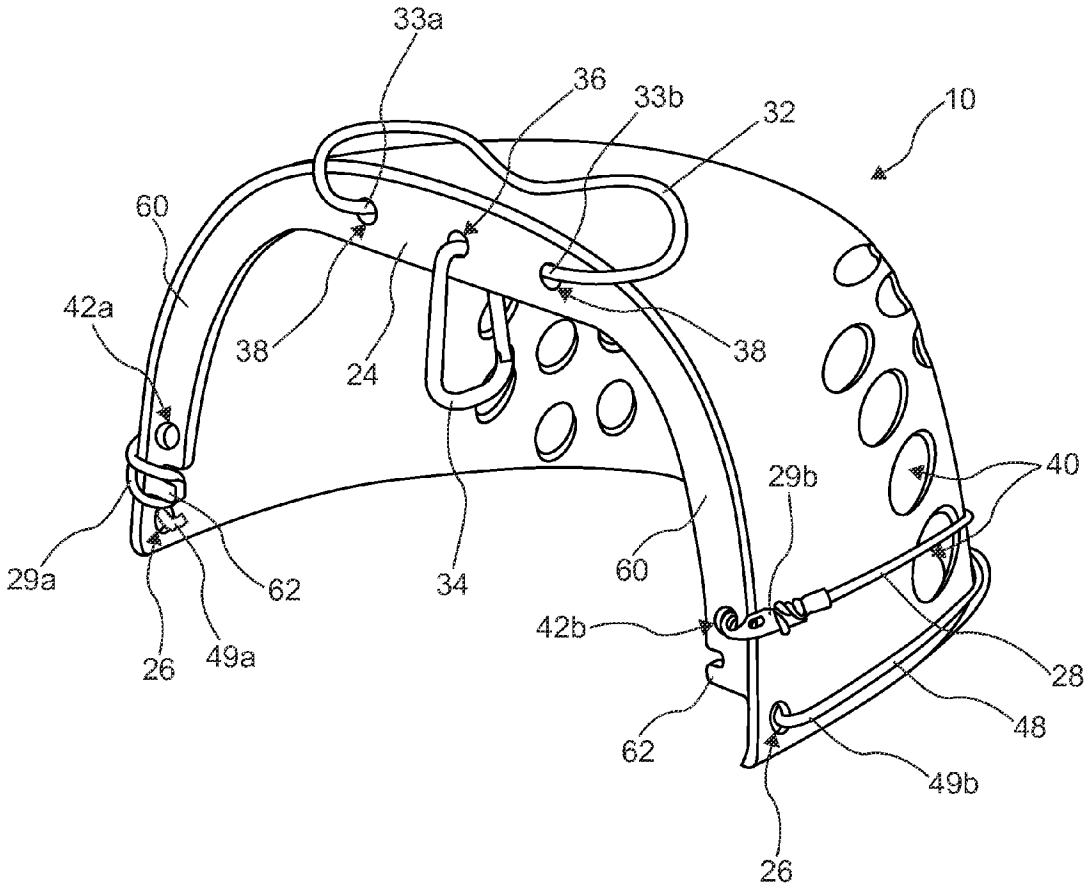
FIG. 2B is a rear perspective view of the headwear support system of FIG. 1 with the golf cap removed according to one embodiment of the present disclosure.
Figure 3:
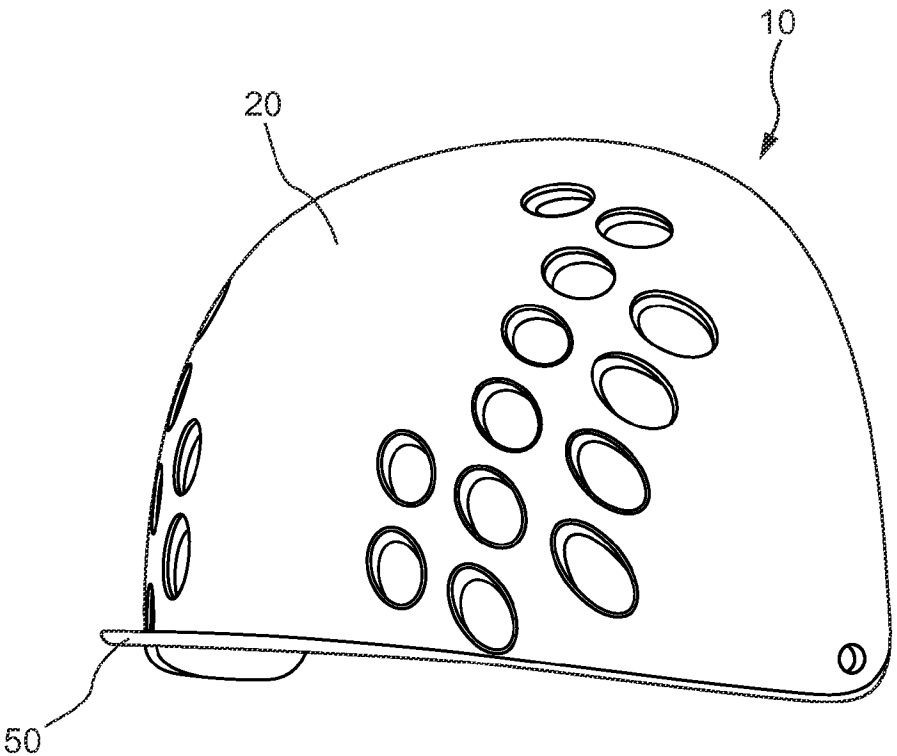
FIG. 3 is a front perspective view of a headwear support system having a flat front projection according to another embodiment of the present disclosure.

Referring now to FIGS. 2A and 2B, in one embodiment, headwear support system 10 includes a support base 20 having a front projection 22 extending outwardly therefrom, a rear connection rib 24 coupled to a rear of support base 20 and having a pair of inward projecting lateral portions 60 extending from a bottom rear of support base 20 (shown best in FIG. 2B), and two diametrically-opposed apertures 26 on a bottom rear of support base 20 (shown best in FIG. 2B). Two diametrically-opposed inward projecting tabs 62 are defined by lateral portions 60 adjacent a bottom of support base 20 and a pair of apertures 42*a*, 42*b* are defined through respective lateral portions 60 above tabs 62 (shown best in FIG. 2B). Headwear support system 10 further includes a first elastic member 48 having opposed ends, wherein each end is configured to be coupled to respective ones of the diametrically-opposed apertures 26, a second elastic member 32 configured to be coupled to rear connection rib 24 and further configured to be selectively coupled to a button 15 of headwear 14, and a third elastic member 28 having opposed ends, wherein each end is configured to be coupled to respective ones of either tabs 62 or apertures 42*a*, 42*b*. A clip member 34 may also be included with headwear support system 10 and is configured to be coupled to an aperture 36 disposed through rear connection rib 24 and further configured to be selectively coupled to travelling case 12. Aperture 36 may have any suitable size and shape depending on the type of clip member 34 utilized.

Referring to FIGS. 1 and 2B, clip member 34 is illustrated as a simple latch mechanism so that it is configured to be selectively coupled to rear connection rib 24 via aperture 36 and further configured to be selectively coupled to travelling case 12. The present disclosure also contemplates that clip member 34 may be permanently affixed to rear connection rib 24 with the use other types of features or no features at all. Clip member 34 may be any suitable latching mechanism that opens and closes so that it can be coupled to travelling case 12, such as straps, belts, strings, Velcro® fasteners, Velcro® loops, Velcro® hook and loop fasteners and closures, etc. Clip member 34 may also be formed from any suitable material. The present disclosure also contemplates that headwear support system 10 come without clip member 34. In this embodiment, a separate clip member or latch, such as one associated with travelling case 12, may be utilized.

One advantage of headwear support system 10 is that it is easy to use, lightweight, compact, and durable, which makes it desirable for use in travelling. In one embodiment, support base 20 is constructed of dishwasher-safe material. In one particular embodiment, support base 20 is formed from a suitable polymer; however, other suitable materials are contemplated by the present disclosure, such as lightweight metals and composites. In the illustrated embodiment, the shape of support base 20 is generally one-half of a hemisphere so that it substantially conforms to the inside volume of headwear 14 (which, in the illustrated embodiment, is a golf cap); however, support base 20 may take on other suitable shapes depending on the inside volume of headwear 14 that a user is trying to protect.

With reference to FIG. 2A, front projection 22 extends outwardly from support base 20 and functions to support brim 13 of headwear 14 (see FIG. 1). Front projection 22 may have any suitable shape; however, in one embodiment, front projection 22 has a shape that is curved to complement the curvature of a curved brim. In other embodiments, such as that shown in FIG. 3, a front projection 50 has a flat shape so that it complements a flat brim. Front projections 22, 50 may be formed integral with or selectively coupled to support base 20, and may have any suitable size or extend from support base 20 any suitable distance depending on how much support is desired for brim 13. One can envision many different front projections depending on the type of headwear 14.

With reference to FIG. 2B, rear connection rib 24, in the illustrated embodiment, may also include apertures 38 for the coupling of an optional second elastic member 32 thereto. Apertures 38 may also have any suitable size and shape depending on the type of second elastic member 32 utilized. The present disclosure also contemplates that the ends of second elastic member 32 be permanently affixed to rear connection rib 24 with the use other types of features or no features at all. Rear connection rib 24, which may be formed integral with or selectively coupled to the top rear of support base 20, may have any suitable size and shape depending on the type of clip member 34 and second elastic member 32 utilized.

Referring now to both FIGS. 2A and 2B, first elastic member 48 includes a main portion 49*c* extending between connector ends 49*a*, 49*b* and is configured to be selectively engaged with diametrically-opposed apertures 26 of support base 20 via connector ends 49*a*, 49*b*, respectively. Apertures 26 may be disposed in any suitable location on the bottom rear of support base 20. One or both of connector ends 49*a*, 49*b* may be any suitable connection mechanisms, such as clips, latches, loops, or anchors. In some embodiments, first elastic member 48 is permanently affixed to support base 20 in the vicinity of apertures 26 with the use other types of features or no features at all. First elastic member 48 functions to secure headwear 14 to support base 20 during transport by selectively coupling main portion 49*c* to crease 19 of headwear 14 (see FIG. 1). When headwear 14 is mounted on support base 20, crease 19 generally coincides with the intersection of support base 20 and front projection 22 so as to secure headwear 14 thereto and preserve its integrity during transport or storage. In one embodiment, first elastic member 48 is a bungee cord; however, other suitable elastic members, such as an elastic band or spring, may be utilized.

Referring to both FIGS. 2A and 2B, second elastic member 32 is configured to be selectively engaged with apertures 38 of rear connection rib 24 via its ends 33*a*, 33*b*, respectively. In some embodiments, second elastic member 32 is permanently affixed to rear connection rib 24 in the vicinity of apertures 38 with the use other types of features or no features at all. Second elastic member 32 functions to provide additional securing of headwear 14 to support base 20 during transport by selectively coupling to button 15 or other suitable feature of headwear 14. In one embodiment, second elastic member 32 is a bungee cord; however, other suitable elastic members, such as an elastic band or spring, may be utilized.

Referring again to both FIGS. 2A and 2B, third elastic member 28 includes a main portion 29*c* extending between connector ends 29*a*, 29*b* and is configured to be selectively engaged with tabs 62 and/or apertures 42*a*, 42*b* via connector ends 29*a*, 29*b*, respectively. Connector end 29*b* is depicted in FIG. 2B as a simple hook-type mechanism; however, one or both of connector ends 29*a*, 29*b* may be any suitable connection mechanisms, such as clips, latches, loops, anchors, Velcro® fasteners, Velcro® loops, Velcro® hook and loop fasteners and closures, etc. In some embodiments, third elastic member 28 is permanently affixed to support base 20 in the vicinity of tabs 62 or apertures 42*a*, 42*b* with the use other types of features or no features at all. Third elastic member 28 functions to secure headwear 14 to support base 20 during transport by selectively coupling main portion 29*c* to a front-half of the crown 17 of headwear 14 (see FIG. 1). In one embodiment, third elastic member 28 is a bungee cord; however, other suitable elastic members, such as an elastic band or spring, may be utilized.

Referring now to FIGS. 2A and 2B, support base 20 is illustrated to include a plurality of openings 40 therein that are configured to reduce the weight of support base 20. In one embodiment, openings 40 reduce the weight of support base 20 by at least 25%. As can be understood by one skilled in the art, the use of openings 40 is optional. Openings may be any suitable size and shape.

In operation of one embodiment of headwear support system 10, headwear 14 is "folded in" by pushing in the back-half of crown 17 and then placed on support base 20 by a user. While the user is holding headwear 14 in place with one hand, first elastic member 48 is manipulated by the user with his or her other hand near main portion 49*c* and stretched over crown 17 to engage main portion 49*c* with crease 19 of headwear 14 to secure headwear 14 to support base 20. Third elastic member 28 may then be manipulated by the user by grabbing end 29*a* (which in the illustrated embodiment is the "free end") and wrapping it around crown 17 to couple end 29*a* to tab 62, thus engaging main portion 29*c* with a front portion of crown 17 to further secure headwear 14 to support base 20. Optionally, headwear 14 may be further secured to support base 20 by coupling second elastic member 32 to button 15 of headwear 14. Clip member 34 is then used to attach headwear support system 10 to travelling case 12, such as luggage, a gym bag, a golf bag or any other suitable travelling case. As understood by one skilled in the art, headwear support system 10 may be attached to travelling case 12 prior to securing headwear 14 to support base 20.

Although embodiments have been described in detail with reference to the accompanying drawings for the purpose of illustration and description, the inventive apparatus is not to be construed as limited thereby. It will be apparent to those of ordinary skill in the art that various modifications to the foregoing embodiments may be made without departing from the scope of the disclosure.

What is claimed is:

1. A headwear support system, comprising:

a support base comprising a front projection extending outwardly therefrom, a rear connection rib coupled to a rear of the support base, and two diametrically-opposed apertures disposed through a bottom rear of the support base;

a first elastic member having opposed ends, each end configured to be coupled to respective ones of the diametrically-opposed apertures, the first elastic member configured to selectively secure the headwear to the support base;

a second elastic member configured to be coupled to the rear connection rib, the second elastic member configured to be selectively coupled to a feature of the headwear; and a clip member configured to be coupled to the rear connection rib, the clip member configured to be selectively coupled to a travelling case.

2. The headwear support system of claim 1, wherein the rear connection rib defines a pair of opposed inward projecting lateral portions extending from a bottom rear of the support base, the inward projecting lateral portions defining two diametrically-opposed tabs and a pair of opposed apertures disposed therethrough.

3. The headwear support system of claim 2, further comprising a third elastic member having opposed ends, each end configured to be coupled to respective ones of either the diametrically-opposed tabs or opposed apertures disposed through the inward projecting lateral portions.

4. The headwear support system of claim 1, wherein the support base is formed from a polymer material.

5. The headwear support system of claim 1, wherein the support base has a shape that is generally one-half of a hemisphere.

6. The headwear support system of claim 1, wherein the front projection has a shape that is selected from the group consisting of flat and curved.

7. The headwear support system of claim 1, wherein the first elastic member is selected from the group consisting of a bungee cord, an elastic band, and a spring.

8. The headwear support system of claim 1, wherein the second elastic member is selected from the group consisting of a bungee cord, an elastic band, and a spring.

9. The headwear support system of claim 1, wherein the third elastic member is selected from the group consisting of a bungee cord, an elastic band, and a spring.

10. The headwear support system of claim 1, wherein the rear connection rib includes three apertures, a first aperture for coupling the clip member thereto, and second and third apertures disposed on either side of the first aperture for coupling the second elastic member thereto.

11. A headwear support, comprising:

a support base having a shape that is generally one-half of a hemisphere, the support base comprising:

a front projection extending outwardly therefrom, the front projection having a shape that is selected from the group consisting of flat and curved;

two diametrically-opposed apertures on a bottom rear of the support base, the apertures configured to couple ends of an elastic member; and an aperture located in a rear, upper section of the support base, the aperture configured to couple a clip member thereto.

12. The headwear support of claim 11, wherein the support base is formed from a polymer material.

13. The headwear support of claim 12, wherein the support base includes a plurality of openings therein configured to reduce the weight of the support base by at least 25%.

14. The headwear support of claim 11, wherein the rear, upper section of the support base comprises a connection rib including an aperture formed therein, the aperture configured to couple the clip member thereto.

15. The headwear support of claim 14, wherein the connection rib comprises second and third apertures formed on either side of the aperture the second and third apertures configured to couple a second elastic member thereto.

16. The headwear support of claim 11, wherein the connection rib further includes a pair of inward projecting lateral portions defining two diametrically-opposed inward projecting tabs.

* * * * *